US006032644A

United States Patent [19]

Bederna et al.

[11] Patent Number: 6,032,644

[45] Date of Patent: Mar. 7, 2000

[54] METHOD AND ARRANGEMENT FOR CONTROLLING AN INTERNAL COMBUSTION ENGINE

[75] Inventors: Frank Bederna, Korntal-Münchingen; Martin Streib, Vaihingen, both of Germany

[73] Assignee: Robert Bosch GmbH, Stuttgart, Germany

[21] Appl. No.: 09/158,110

[22] Filed: Sep. 22, 1998

[30] Foreign Application Priority Data

Sep. 24, 1997 [DE] Germany ..... 197 42 083

[51] Int. Cl.[7] ..... F02D 41/04; F02D 41/22

[52] U.S. Cl. ..... 123/339.15; 123/396; 123/688

[58] Field of Search ..... 123/333, 339.15, 123/436, 479, 688, 690, 361, 399, 396, 397

[56] References Cited

U.S. PATENT DOCUMENTS

| | | | |
|---|---|---|---|
| 5,391,127 | 2/1995 | Nishimura | 477/110 |
| 5,429,091 | 7/1995 | Huber et al. | 123/399 |
| 5,623,905 | 4/1997 | Kau et al. | 123/361 |
| 5,623,906 | 4/1997 | Storhok | 123/419 |
| 5,692,472 | 12/1997 | Bederna et al. | 123/350 |
| 5,775,311 | 7/1998 | Kato et al. | 123/681 |

*Primary Examiner*—Tony M. Argenbright
*Assistant Examiner*—Arnold Castro
*Attorney, Agent, or Firm*—Walter Ottesen

[57] ABSTRACT

The invention is directed to a method and an arrangement for controlling an internal combustion engine wherein the operational reliability of the control is ensured by comparing the actual torque of the engine to a maximum permissible torque. This torque comparison is switched off and another monitoring function is activated when a fault in the area of charge detection is suspected.

10 Claims, 3 Drawing Sheets

METHOD AND ARRANGEMENT FOR CONTROLLING AN INTERNAL COMBUSTION ENGINE

BACKGROUND OF THE INVENTION

A method and an arrangement for controlling an internal combustion engine are disclosed in U.S. Pat. No. 5,692,472. Here, to ensure the operational reliability of the engine, a maximum permissible torque of the engine is formed at least on the basis of the position of an operator-controlled element actuated by the driver. This maximum permissible torque is compared to an actual torque of the engine. If the actual torque exceeds the maximum permissible torque, then a fault function of the control is assumed and measures are initiated to react to the fault, especially the cutoff of the metering of fuel to the engine, until the actual torque again drops below the maximum permissible torque. The monitoring of the basis of the maximum permissible torque is dependent upon the precision of the actual torque of the engine. The torque is computed on the basis of a quantity (for example, the supplied air mass) representing the load or charge. In this way, the precision is primarily dependent upon the precision of the load detection or charge detection. For a fault in the detection of the charge, more torque can be outputted by the engine than wanted by the driver notwithstanding the reliable torque comparison. This occurs, for example, when the quiescent fault results in an air mass signal, load signal or charge signal which is too small so that the actual torque of the engine computed therefrom is too small compared to the actually outputted torque.

SUMMARY OF THE INVENTION

It is an object of the invention to improve monitoring of the control of an internal engine.

The method of the invention is for controlling an internal combustion engine equipped with an operator-controlled element actuable by a driver. The method includes the steps of: detecting the position of the operator-controlled element; determining a maximum permissible torque of the engine at least in dependence upon the position of the operator-controlled element; determining the actual torque of the engine; comparing the actual torque to the maximum permissible torque thereby defining a first monitoring function and initiating a fault reaction measure when the actual torque exceeds the maximum permissible torque; providing a signal representing the charge of the engine; and, switching off the first monitoring function and activating a second monitoring function when a fault is suspected in the area of detecting the charge of the engine.

The monitoring of the control of an internal combustion engine is improved for quiescent and therefore undetected faults in the area of load detection or charge detection. A torque of the engine, which is too great compared to the driver command, is not detected by the known torque comparison as a consequence of the quiescent fault in the area of load detection or charge detection. This torque which is too great compared to the driver command is effectively countered.

It is especially advantageous that the switchover from the torque comparison to another monitoring function is only undertaken when a quiescent fault is assumed in the area of load detection and/or charge detection. This torque comparison ensures the operational reliability of the engine for a correct load detection and charge detection.

In an advantageous manner, this is determined by an evaluation of the diagnosis of a λ-control and/or by evaluating the measured air mass signal, an air mass signal computed from the position of the throttle flap and a factor of the λ-control.

BRIEF DESCRIPTION OF THE DRAWINGS

The invention will now be explained with reference to the drawings wherein.

DESCRIPTION OF THE PREFERRED EMBODIMENTS OF THE INVENTION

Figure 1:
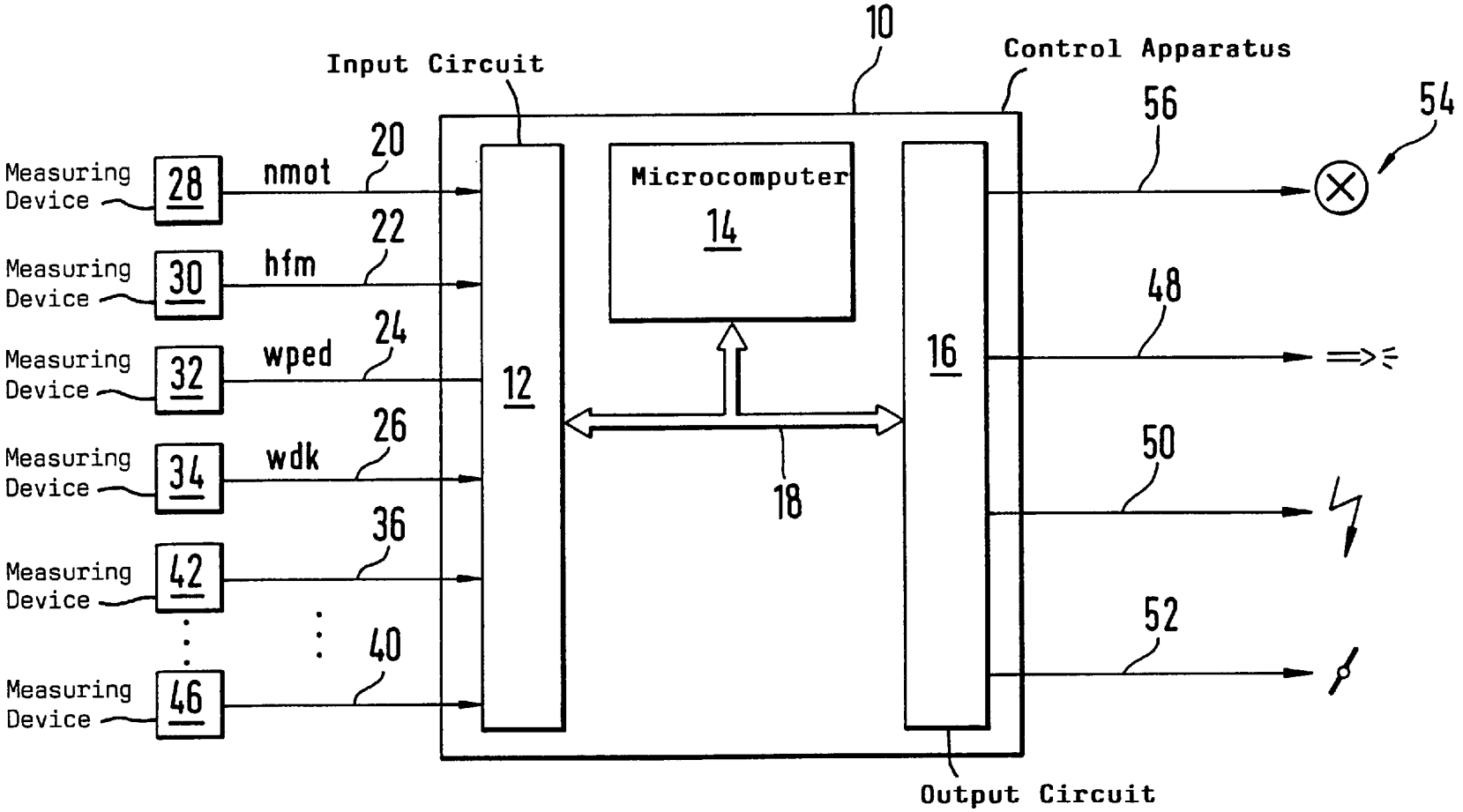
FIG. 1 is a block circuit diagram showing an electronic control apparatus for controlling an internal combustion engine.

FIG. 1 shows an electronic control apparatus 10 for controlling an internal combustion engine. The control apparatus 10 includes an input circuit 12, at least one microcomputer 14 and an output circuit 16. The above-mentioned elements are connected to each other via a communication connection 18 which facilitates a mutual exchange of data. Input lines 20, 22, 24 and 26 are connected to the input circuit 12. These input lines are connected, respectively, to a measuring device 28 for detecting the engine rpm nmot, a measuring device 30 for detecting the fresh air quantity hfm supplied to the engine, a measuring device 32 for detecting the position wped of the accelerator pedal and a measuring device 34 for detecting the position wdk of a throttle flap of the engine. Furthermore, additional input lines 36 to 40 are provided which supply additional operating variables of the engine and/or of the vehicle from corresponding measuring devices 42 to 46. These operating variables are evaluated for controlling the engine. Such operating variables are, for example, the intake air temperature, ambient pressure, intake manifold pressure, exhaust gas composition, et cetera. The control apparatus 10 emits output signals via the output circuit 16 to control the power of the engine. Via the output circuit 16, the engine adjusts the metering of fuel (symbolized by line 48), the ignition time point (symbolized by line 50) and the charge (air supply) of the engine (symbolized by line 52) via a throttle flap of the engine. Furthermore, at least one fault lamp 54 is provided which is driven by the control apparatus 10 via the output circuit 16 and the output line 56 in the case of a fault.

In the normal operation of the control system and in a preferred embodiment of the invention, a desired value for a torque of the engine is pregiven at least on the basis of the accelerator pedal position wped and the engine rpm nmot as known from the state of the art initially referred to herein. This torque desired value is, on the one hand, converted into a desired position of the throttle flap of the engine while considering the following: the fresh air/fuel mixture of the engine determined in dependence upon the air mass signal hfm, the conditions in the intake manifold of the engine and the engine rpm. This desired value is controlled to via a position control loop. On the other hand, the desired value is converted into desired values for the fuel metering and the ignition angle to be adjusted while considering the then present adjustment of the engine with respect to the ignition angle and/or the fuel metering. Together, these interventions lead to a control of the torque of the engine to a pregiven value. Furthermore, an adaptive lambda control is provided which holds the mixture composition at a pregiven ratio. A fault is detected and the fault lamp 54 driven when an actuating variable of this controller (for example, the adaptation variable or the actuating variable of the controller) exceeds a pregiven value. To ensure the operational reliability of the control system, a torque comparison is provided as known from the state of the art initially referred to herein.

In the embodiment described below, a control system is disclosed wherein a signal is evaluated for detecting the charge. This signal is outputted by a corresponding sensor and represents the air mass supplied to the engine. Here, a procedure is described wherein this signal is associated with an undetected quiescent fault. The described procedure is applied in the same way when an intake manifold pressure signal forms a basis of the charge detection in lieu of the air mass signal. Furthermore, the non-detected, quiescent fault can, in addition to a fault in the supplied signal itself, be a fault in the area of the evaluation of the signal which leads to a charge signal associated with a fault.

The air mass signal hfm, which is detected by the measuring device 30, serves as a command variable in the control of the engine for the computation of the fuel quantity, the ignition time point and, as shown above, for the adjustment of the throttle flap. A fault or an imprecision in the context of the detection of the air mass can lead to the situation that the torque of the engine increases above the value desired by the driver. It can especially happen that the throttle flap is opened further than wanted by the driver. This is, for example, the case when too small a value of the air mass is determined (and therefore a charge value which is somewhat too small).

In the extreme case, with the defective performance of the air mass detection or charge detection described, approximately 50% more idle torque can be adjusted for a released accelerator pedal than permitted in this case. As a consequence of the faulty air mass signal (or the faulty charge detection), the actual torque of the engine, which is computed on the basis of this signal, is not correct. Accordingly, the detection of the fault via the torque comparison, which is known from the state of the art, is not possible in all operating situations.

According to a feature of the invention and in view of the above, the torque comparison is switched off when a fault is suspected in the area of air mass detection or charge detection and a switchover is made to another monitoring function. In the preferred embodiment, a monitoring function is utilized wherein the metering of fuel to the engine is switched off when the accelerator pedal is released and the engine rpm is above a pregiven threshold value (such as 1500 rpm). This monitoring function is utilized only in the case of a fault in the area of the charge detection. For this reason, the effects with respect to the following can be neglected: exhaust gas-composition, catalytic converter and the driving comfort.

For fault detection, the following characteristic is utilized: the mixture composition of the engine is lean in the above-described case. The $\lambda$-control corrects the fuel quantity as fast as possible with the objective of adjusting a pregiven $\lambda$-desired value, as a rule, $\lambda=1$. This performance of the $\lambda$-control is evaluated for fault determination.

Figure 2:
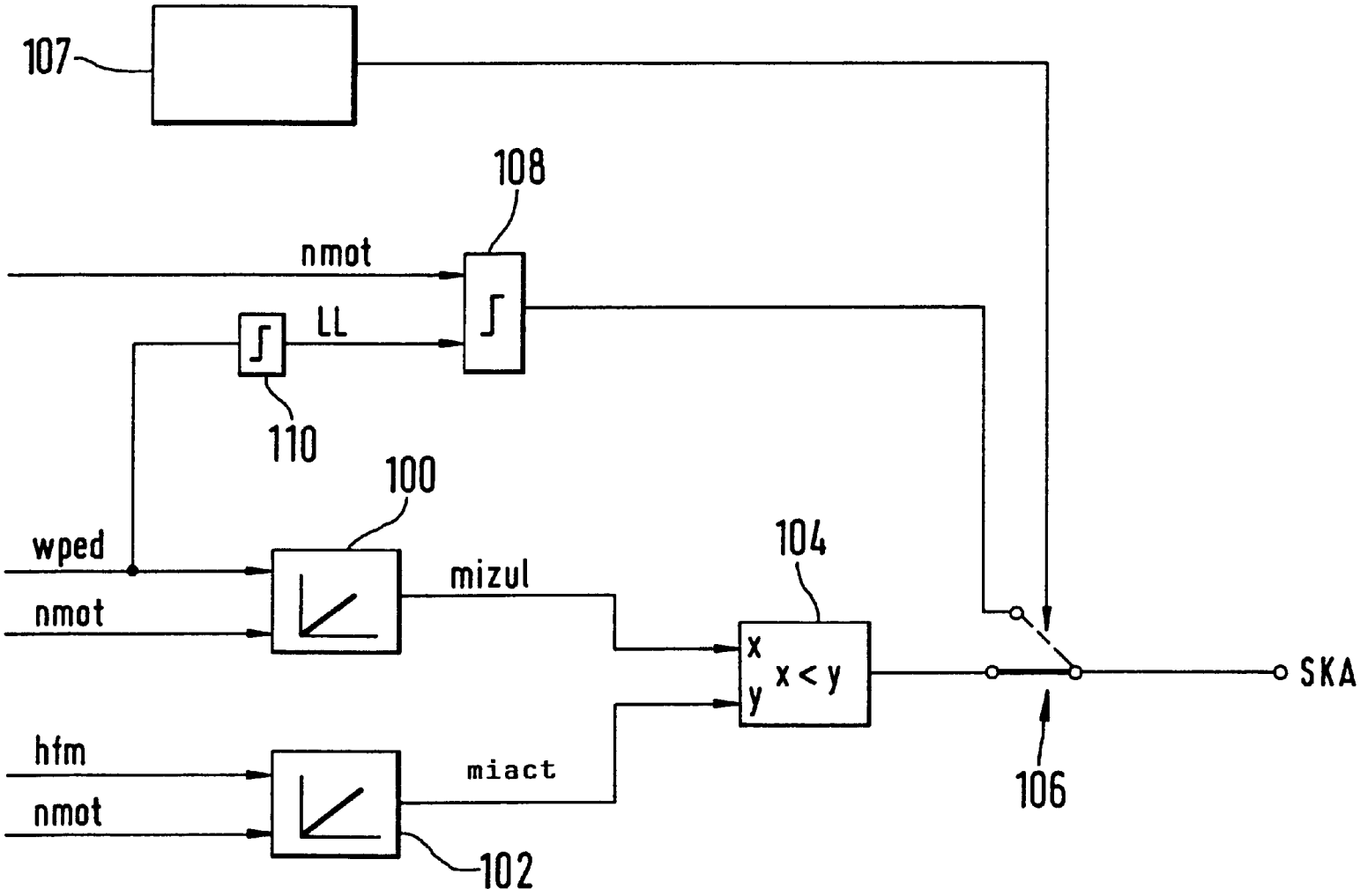
FIG. 2 is a flow diagram in the form of a block circuit diagram showing the switchover of the monitoring functions described herein; and, FIG. 3 is a flow diagram showing a procedure with the aid of which a quiescent fault can be detected in the area of load detection and/or charge detection.
Figure 3:
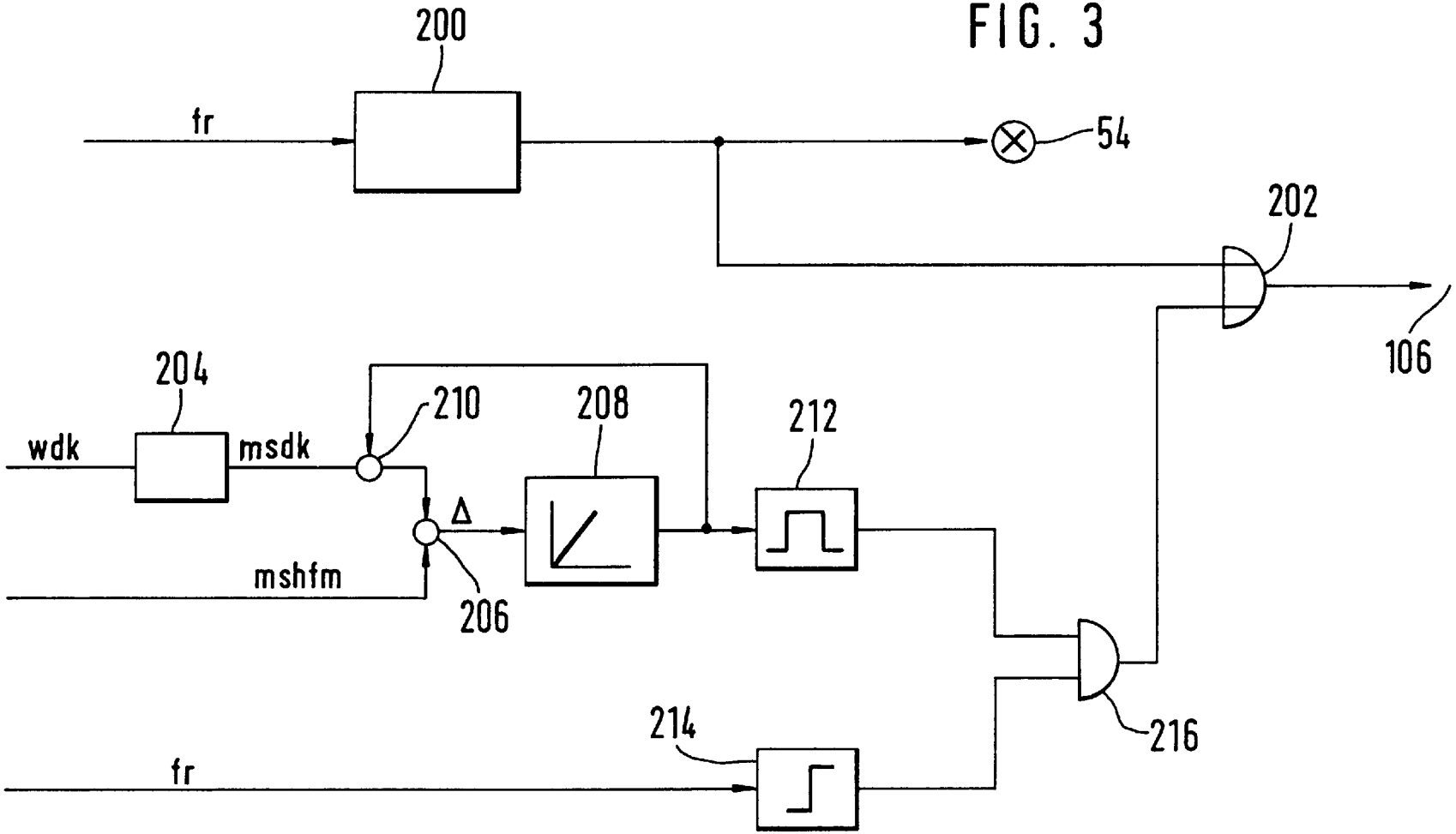

The switchover of the monitoring functions is shown in the flow diagram of FIG. 2. The form of the illustration of the flow diagram is selected for reasons of clarity and is the same in FIG. 3. The realization of the above procedure is realized in the preferred embodiment as a program of the microcomputer 14 of the control apparatus 10. The elements in the respective views of FIGS. 2 and 3 represent programs, subprograms or program steps of such a realization.

The maximum permissible torque mizul of the engine is read out in a first characteristic field 100 from the accelerator pedal position wped and the engine rpm nmot. In another characteristic field 102, an actual torque miact of the engine is computed from the supplied air mass signal hfm and the engine rpm nmot as well as from the efficiency of the actual ignition angle setting. The two signals are supplied to a comparator 104 which, if required after a certain delay time, outputs an output signal when the actual torque miact is greater than the maximum permissible torque mizul. If the comparator 104 outputs an output signal, then a fault reaction is initiated which leads to a switchoff of the metering of fuel to the engine (safety fuel shutoff SKA). In this way, the actual torque of the engine is reduced and again drops below the maximum permissible torque.

For the above-mentioned reasons, this torque comparison is switched off and another monitoring function is switched on when there is an assumed fault in the area of the air mass detection and/or of the charge detection. This takes place by means of the switch element 106. The switch element 106 is switched from the position shown by the solid line into the position shown by the broken line when there is a suspected fault in the area of the charge detection. This suspected fault is detected in fault determination 107. Accordingly, if a fault of this kind is suspected, the safety fuel cutoff is activated when a further comparator 108 outputs an output signal. The engine rpm nmot as well as a signal LL are supplied to this comparator. The signal LL represents the released accelerator pedal. In the preferred embodiment, a released accelerator pedal is detected in that the accelerator pedal position wped drops below a pregiven threshold value. This is determined in the threshold value stage 110 which generates an output signal when the accelerator pedal position drops below the pregiven threshold value. If this is the case, the comparator 108 compares the supplied engine rpm to a pregiven maximum rpm which lies, for example, at 1500 rpm. If the engine rpm exceeds this maximum rpm, the comparator 108 outputs an output signal which triggers the safety shutoff SKA.

The torque comparison is switched off when a defect is suspected in the detection of the air mass or the detection of the charge and, in the preferred embodiment, a monitoring function is activated which switches off the metering of fuel to the engine with the accelerator pedal released when a pregiven rpm is exceeded.

In another advantageous embodiment, not only is the engine rpm compared to a pregiven maximum value with the accelerator pedal released but, for different accelerator pedal position ranges, different maximum rpms are pregiven or pregiven engine rpms are derived from a characteristic line in dependence upon the accelerator pedal position and, when these maximum engine rpms are exceeded, the metering of fuel to the engine is switched off.

In fault determination 107, a determination is made as to whether a fault could be present in the area of charge detection especially as to whether the air mass detection can be assumed to be defective. This can take place in different ways.

In the simplest case, a comparison is carried out as to plausibility between the detected air mass signal hfm and the throttle flap position wdk. A fault in the area of the air mass detection is suspected when the two variables deviate from each other by an impermissible amount. Here, one of the two variables must be converted into the other (for example, throttle flap position into an air mass flow).

In another embodiment, the performance of the λ-control is utilized. If a defective air mass signal such as an air mass signal which is too small is present, then a mass of fuel is injected which is too small compared to the then larger air mass actually supplied in dependence upon the driver command. This has the consequence that the λ-control corrects the metering of fuel and the fuel mass is increased. In this operating situation, the control factor and/or the adaptation factor of the λ-control exceeds a corresponding limit value after a certain time. A fault in the area of the fuel supply is assumed which leads to a continuous lean operation of the engine not wanted in this situation. A corresponding fault mark is set and the fault lamp is driven. In this case, and in accordance with the above procedure, a fault is suspected in the area of charge detection (especially in the detection of the air mass) so that a switchover of the monitoring functions takes place. The fault detection time is relatively long and is non-critical because not an obvious fault is intended to be detected but only the probability of the presence of a quiescent fault in the area of charge detection should be made more evident.

In a further embodiment, a combination of the two described detection functions is provided. For this purpose, an air mass flow, which is computed from the throttle flap position while considering the conditions in the intake manifold, is compared to the air mass flow detected by the sensor. The difference is supplied to an integrator whose output signal is used to correct the air mass flow computed from the throttle flap position. Accordingly, an adjustment takes place between the air mass flow, which is computed on the basis of the throttle flap position, and the measured air mass flow. If this adjustment factor is within a pregiven range, then a check is made as to whether a factor of the λ-control exceeds a predetermined threshold value. This is the case when a very small difference is present between the measured and the computed air mass flow for a certain time. In this case, and as explained above, the λ-control intervenes to adjust the mixture composition which leads to a control factor and/or an adaptation factor above a pregiven threshold value. If both these conditions are satisfied, then a quiescent fault in the area of charge detection, and especially in the detection of air mass, is assumed and the monitoring function is switched over.

The above-mentioned criteria for the assumption of a quiescent fault in the area of air mass detection are utilized individually or in any desired combination.

The last two mentioned criteria are shown on the basis of the flow diagram in FIG. 3.

In block 200, an improper adjustment of the fuel metering system in the direction of lean is detected on the basis of at least a λ-control factor fr. This leads to a corresponding output signal which does the following: sets a fault mark, drives the warning lamp 54 and leads to a switchover of the monitoring function (switch element 106) via an OR-gate 202.

Furthermore, in 204, the throttle flap angle wdk is converted into an air mass flow msdk while considering the conditions in the intake manifold. This air mass flow msdk is compared to the measured air mass flow mshfm (signal hfm) in the comparator element 206. The difference Δ is supplied to an integrator 208 whose output signal leads to a correction (addition or multiplication) of the air mass flow msdk in the correction element 210. The output signal of the integrator 208 is further supplied to a threshold value element 212 which outputs an output signal when the output signal of the integrator lies within a pregiven range. Furthermore, a factor of the λ-control fr (preferably the adaptation factor) is compared to a pregiven threshold value in the threshold value element 214. If the control factor exceeds this threshold value, the element 214 emits an output signal. The output signals of elements 212 and 214 are supplied to an AND-gate 216 whose output signal leads to the switchover of the monitoring function via the OR-gate 202. The monitoring function is then switched over in this case when the integrator count 208 does not exceed the pregiven threshold value, that is, when it lies in a pregiven range while the control factor of the λ-control exceeds a threshold value.

In addition to the fault in the area of air mass detection, a fault in the area of the further processing of the air mass signal to a charge signal can be detected in this manner so that a switchover of the monitoring functions takes place also when a quiescent fault is present there.

It is understood that the foregoing description is that of the preferred embodiments of the invention and that various changes and modifications may be made thereto without departing from the spirit and scope of the invention as defined in the appended claims.

What is claimed is:

1. A method for controlling an internal combustion engine equipped with an operator-controlled element actuable by a driver, the method comprising the steps of:

detecting the position of said operator-controlled element;

determining a maximum permissible torque of said engine at least in dependence upon said position of said operator-controlled element;

determining the actual torque of said engine;

comparing said actual torque to said maximum permissible torque thereby defining a first monitoring function and initiating a fault reaction measure when said actual torque exceeds said maximum permissible torque;

providing a signal representing the charge of said engine; and, switching off said first monitoring function and activating a second monitoring function when a fault is suspected in the area of detecting said charge of said engine.

2. The method of claim 1, wherein said first monitoring function is switched off when a fault is suspected in the area of detecting the air mass to said engine.

3. The method of claim 1, said second monitoring function comprising:

detecting the rpm of said engine; and, at a pregiven position of said operator-controlled element, initiating a fault reaction when said engine rpm exceeds a pregiven engine rpm.

4. The method of claim 3, wherein said position of said operator-controlled element is the released position thereof.

5. The method of claim 3, wherein said operator-controlled element is an accelerator pedal which moves through a total accelerator pedal range partitioned into subranges; and, wherein t he method comprises the further steps of:

providing pregiven engine rpms over said total accelerator pedal range or over at least some of said subranges; and, cutting off the supply of fuel to said engine when said pregiven engine rpms are exceeded.

6. The method of claim 1, wherein said engine has a throttle flap; and, wherein said method comprises the further step of detecting a fault in the area of detecting the charge of said engine by:

measuring the air mass flow to said engine;

determining the position of said throttle flap;

computing the air mass flow to said engine on the basis of said position of said throttle flap; and, suspecting a fault when the value of the measured air mass flow and the value of the computed air mass flow deviate impermissibly.

7. The method of claim 6, wherein said engine is equipped with a λ-control; and, wherein said method comprises the further step of detecting a fault in the area of detecting the charge of said engine when a factor of said λ-control exceeds a pregiven threshold value when said air mass flows are adjusted to each other.

8. The method of claim 1, wherein said engine is equipped with a fuel supply system; and, wherein said method comprises the further step of recognizing a fault in the area of the detection of said charge of said engine when a diagnosis of said fuel supply system indicates that a threshold has been exceeded in the direction of a lean air/fuel mixture.

9. An arrangement for controlling an internal combustion engine equipped with an operator-controlled element actuable by a driver, the arrangement comprising:

means for sensing the position of said operator-controlled element;

means for providing a signal representing the charge of said engine;

an electronic control apparatus including:

means functioning to determine a maximum permissible torque of said engine at least in dependence upon said position;

means functioning to determine the actual torque of said engine;

a comparator for comparing said actual torque to said maximum permissible torque thereby defining a first monitoring function and for initiating a fault reaction measure when said actual torque exceeds said maximum permissible torque; and, means for detecting said signal and for switching off said first monitoring function and activating a second monitoring function when a fault is suspected in the area of detecting said charge of said engine.

10. The arrangement of claim 9, wherein said first monitoring function is switched off when a fault is suspected in the detection of the air mass supplied to said engine.

* * * * *